US005638575A

United States Patent [19]

Sin

[11] Patent Number: 5,638,575

[45] Date of Patent: Jun. 17, 1997

[54] VACUUM CLEANERS

[75] Inventor: Timmy Hok Yin Sin, Hong Kong, Hong Kong

[73] Assignee: Techtronic Industries Co., Ltd., Hong Kong

[21] Appl. No.: 448,842

[22] Filed: May 24, 1995

[51] Int. Cl.[6] ..... A47L 5/26

[52] U.S. Cl. ..... 15/413; 15/344

[58] Field of Search ..... 15/412, 413

[56] References Cited

U.S. PATENT DOCUMENTS

| | | | |
|---|---|---|---|
| 2,291,689 | 8/1942 | Carlson | 15/413 |
| 2,314,334 | 3/1943 | Frantz | 15/413 |
| 3,383,765 | 5/1968 | Meltzer | 15/413 X |
| 3,454,978 | 7/1969 | Kuwahara | 15/413 X |
| 3,854,164 | 12/1974 | Schmitz | 15/413 X |
| 5,421,058 | 6/1995 | Zahuranec et al. | 15/413 |

*Primary Examiner*—Chris K. Moore
*Attorney, Agent, or Firm*—Gunn, Lee & Miller, P.C.

[57] ABSTRACT

A vacuum cleaner includes an electric motor which drives a suction fan to draw air and debris into the cleaner via an inlet. The air and debris pass along a passageway and creates a suction at a bleed way to draw air through the motor and out of a compartment. Air enters the compartment through vents (not shown) in a side of an outer housing. The arrangement enhances the cooling of the motor and uses air uncontaminated with debris.

7 Claims, 2 Drawing Sheets

VACUUM CLEANERS

BACKGROUND OF THE INVENTION

1. Field of the Invention

The invention relates to vacuum cleaners.

2. Description of the Prior Art

The invention relates particularly although not exclusively to hand holdable vacuum cleaners. Vacuum cleaners are normally driven by electric motors and in the case of hand holdable cleaners may be supplied from re-chargeable power packs. It is well known that electric motors generate heat and become hot in use and one way of reducing the capacity of an electric motor that is required for a certain task is to provide adequate cooling of the motor. It is possible to provide a separate fan for driving air over the motor but this takes up valuable space in a product where overall dimensions are often at a premium. The main fan, that is provided for creating the main vacuum, draws in air which is inherently contaminated with dust, debris and any other matter drawn into the vacuum cleaner during use. The main stream of air entering the vacuum cleaner is therefore generally unsuitable for cooling the electric motor. Generally stated, providing an extra fan or using air drawn in by the main fan therefore introduces certain respective problems.

SUMMARY OF THE INVENTION

It is an object of the invention to overcome or substantially reduces these problems.

According to the invention there is provided a vacuum cleaner having a fan, an electric motor connected to drive the fan, a vented closed compartment enclosing the motor, an inlet to allow air and debris to enter the cleaner, and an air passageway mounted adjacent one side of the compartment and extending at least between the inlet and the fan, in which a bleed way is provided communicating between the compartment and the passageway arranged so that a differential pressure is created in use between the compartment and the passageway to draw air out of the compartment into the passageway.

The bleed way may be positioned in the passageway between the inlet and the fan.

Vents in the compartment are preferably positioned opposite one end of the motor and the bleed way positioned opposite another end of the motor.

The motor may be mounted on one or more inwarding extending ribs in the compartment arranged to at least partially prevent air passing along an outside of the motor so that air is drawn through an inside of the motor by the differential pressure.

A protrusion may be provided upstream of the bleed way extending partially across the passageway to enhance the differential pressure created in the passageway. The protrusion may be integrally formed with the compartment.

An embodiment of the invention may comprise a hand holdable vacuum cleaner having a fan, a vented closed compartment enclosing the motor connected to a fan through one end of the compartment, an inlet to allow air and debris to enter the cleaner, and a passageway extending between the inlet and the fan extending along one side of the compartment, in which a bleed way is provided communicating between the compartment and the fan adjacent the inlet having a deflector protrusion extending into the passageway positioned downstream of the inlet arranged so that differential pressure is created in use to draw air out of the compartment into the passageway and in which the inlet, the compartment, the passageway, the bleed way, and the protrusion are integrally formed in a housing.

The integrally formed part is preferably formed in two like halves, each half comprising half of the compartment, half of the inlet, half of the passageway, half of the bleed way and half of the protrusion.

BRIEF DESCRIPTION OF THE DRAWINGS

A hand holdable vacuum cleaner according to the invention will now be described by way of example with reference to the accompanying drawings in which.

DESCRIPTION OF THE PREFERRED EMBODIMENTS

Figure 1:
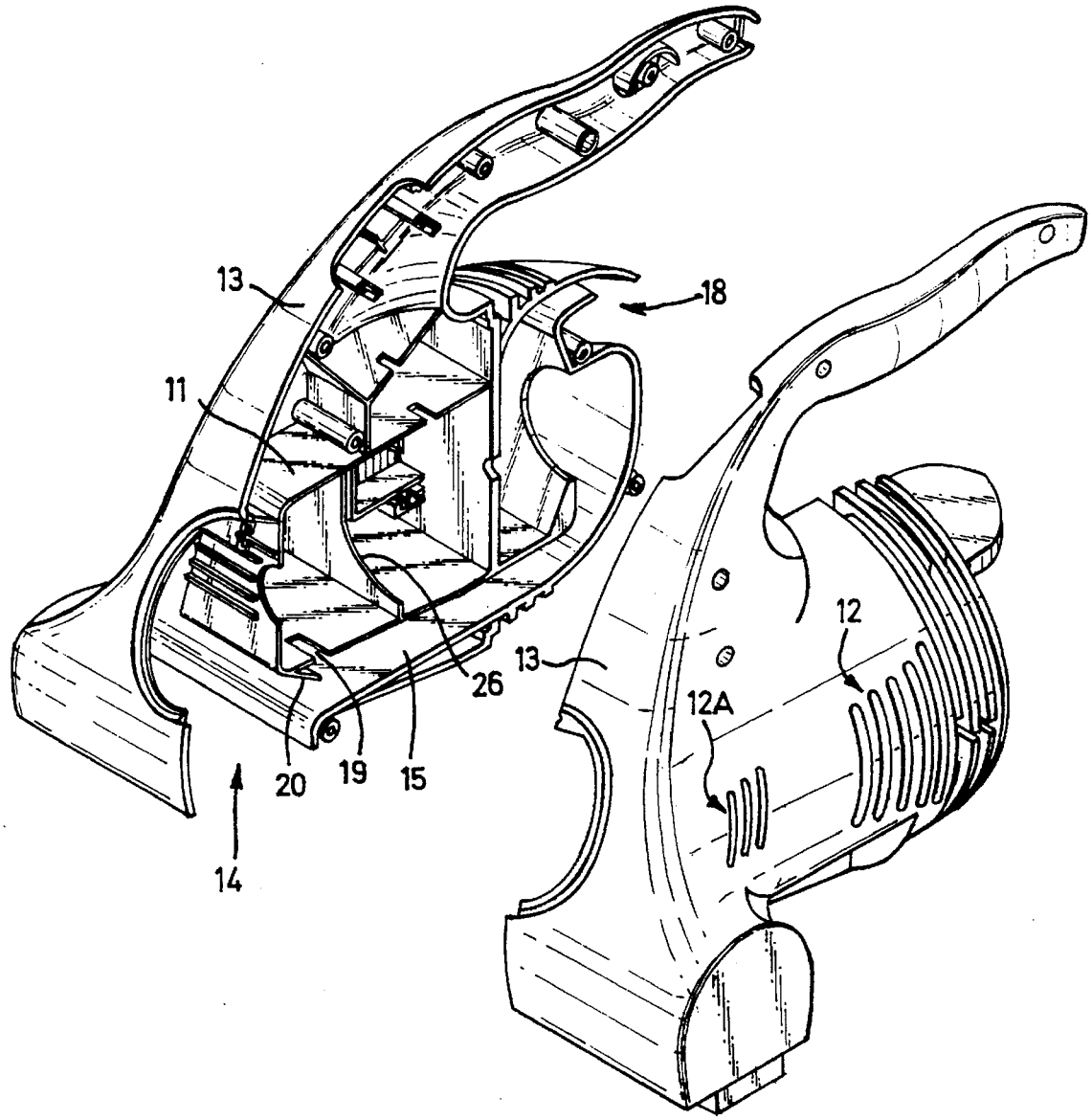
FIG. 1 is an isometric view of the separated halves of the cleaner.

Referring to the drawings, the vacuum cleaner includes an electric motor 10, a closed compartment 11 having vents 12 extending through to an outside of an integrally formed plastics housing 13. An inlet 14 is provided at one end of the housing 13, and an air passageway 15 extends along one side of the compartment 11 extending between the inlet 14 and a fan 16. A soft air-pervious bag 17 is held over an outlet 18 of the passageway beyond the fan 16 to collect debris drawn into the inlet 14 in use by the vacuum cleaner.

A bleed way 19 is provided by a rectangular slot in the one side of the housing adjacent the inlet 14. An integrally formed protrusion 20 extends partially across the passageway 15 upstream of the bleed way 19. The protrusion 20 serves to deflect air drawn through and along the passageway 15 and create a narrowing of the passageway 15 which serves to create a differential pressure. As a result, air to be drawn out of the compartment 11 into the passageway 15 in use. Extended arrows in FIG. 2 show the flow of air in the vacuum cleaner during use.

Figure 2:
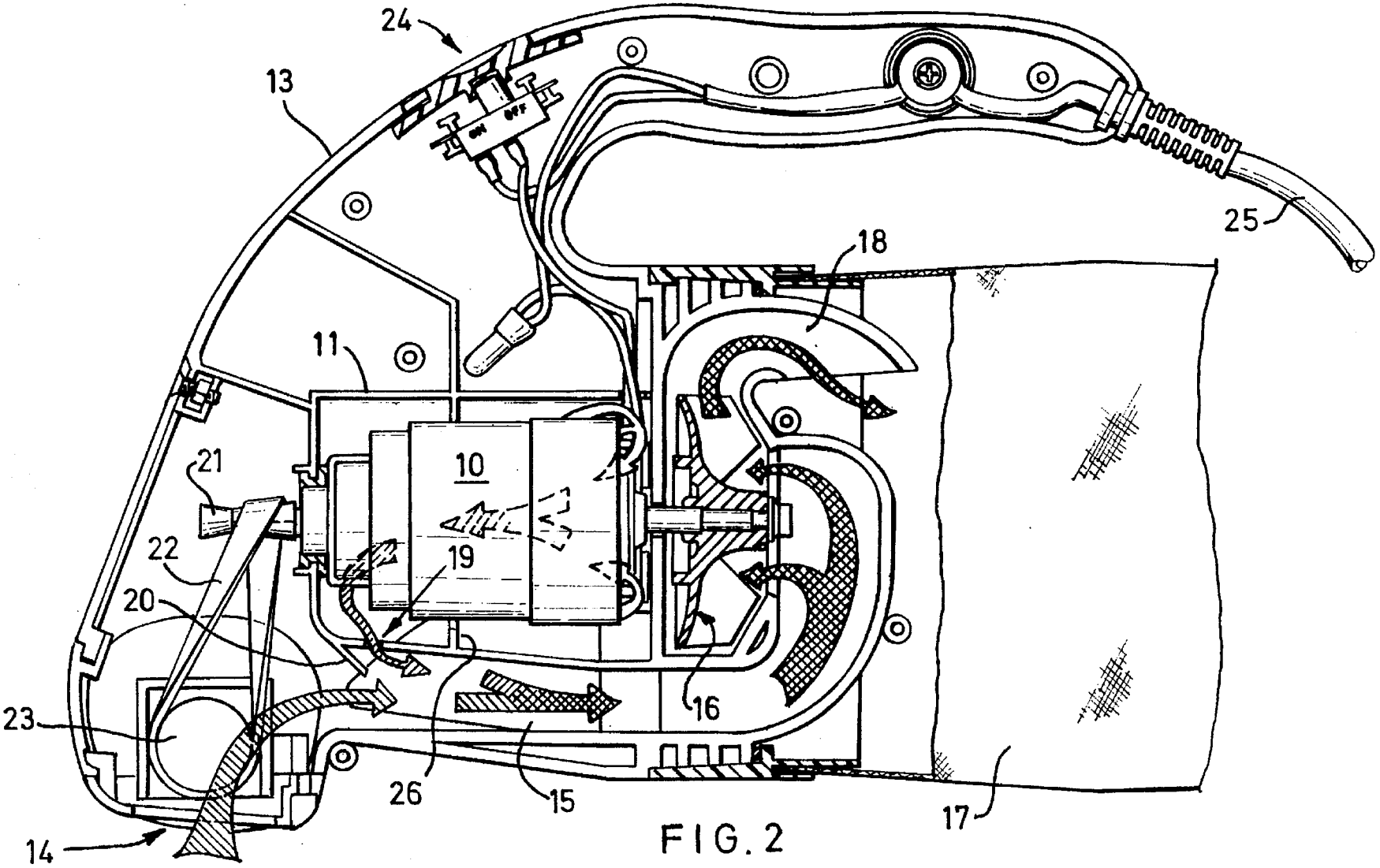
FIG. 2 is a schematic side view showing of one half of the cleaner and its principal working components.

Other parts of the cleaner shown in FIG. 2 include a pulley 21 connected to a shaft of the motor 10, and a drive belt 22 extending between the pulley 20 and a cylindrical brush 23 extending across the inlet 14. A thumb operated ON-OFF electrical switch 24 is mounted above the motor 10 and is arranged to control power supplied to the motor 10 from an electrical supply cable 25.

During operation of the vacuum cleaner air is drawn (or bleeds) out of the compartment 11 as a result of air passing along the passageway 15 between the inlet 13 and the fan 15. This is due to the protrusion 20 creating a venturi in the passageway 15 adjacent the bleed way 19. It will be appreciated that the venturi could be formed by narrowing the passageway in some other way, for example by forming the sides of the passageway with inwardly curved opposing sides to form a narrowing in the passageway opposite the bleed way 19. In any event as a result of the venturi, because air is drawn out of the compartment 11, air is drawn into the compartment 11 mainly through the vents 12 from outside the housing 13 to cool the motor 10. It will be noted, as can be seen in FIG. 2, this air is drawn into the compartment 11 through the vents 12 which are opposite one end of the motor 10. Air exits from the bleed way which is opposite the other end of the motor. In this way cooling air is drawn along the length of the motor 10. Further, the motor 10 is mounted between an inwardly extending rib 26 which surrounds the outside of the motor so that cooling air must flow through the inside of the motor 10. In practice, the rib 26 may be formed with cut-outs or slots to allow some air to pass along the outside of the motor if preferred.

The described arrangement enables and causes a flow of cooling air from the motor 10 to enter the housing 11 via the vents 12 and to pass at least predominantly along the inside of the motor 10 into the passageway 15. Some cooling air is also drawn in through vents 12A and passes directly across the other end of the motor 10. The motor cooling air is not contaminated with debris or dust and no extra external fan is required to create a flow of cooling air for the motor 10. The motor 10 has however a conventional internal fan (not shown) which draws air along the inside of the motor in cooperation with the suction created at the bleed way 19.

It will be appreciated that the bleed way 19 may be positioned in the passageway 15 beyond the fan provided a suitable venturi is provided in the passageway at that point to create the necessary differential pressure. Also in another embodiment, the bleed way 19 is situated opposite the one end of the motor and at least main vents are positioned opposite the other end of the motor. As a result, air is drawn along the motor 10 from left to right in FIG. 1. Where a d.c. motor is used, it is preferable to arrange for air to be drawn in a direction so as to flow away from the commutator such that any carbon dust released at the brushes is not drawn into the inside of the motor, for example. With embodiments of the invention the direction of flow of cooling air can be relatively easily chosen to suit whichever end of a d.c. motor the commutator is required to be positioned for other reasons. For a.c. motors the direction of flow of cooling air is normally irrelevant.

The cooling of the motor enables the motor 10 to be serviceable for a longer time period or a smaller capacity motor than otherwise can be used. In addition, or as an advantage standing alone, satisfactory cooling means that the motor will run at a lower temperature in operation and so less heat insulation is required or less discomfort will arise generally to hands of users of the vacuum cleaner described because the temperature of the motor 10 and the housing 13 will be lower.

It will be noted and as clearly shown in FIG. 2, the housing 13 is formed in two like opposing halves. As such the two halves can be readily moulded and formed of plastics material. When the two halves are brought and joined or fixed together, the compartment 11 and passageway 15 are formed as well bearing supports provided for the motor 10.

I claim:

1. A vacuum cleaner having a fan, an electric motor connected to drive the fan, a vented compartment enclosing the motor, an inlet to allow air and debris to enter the cleaner, and an air passageway mounted adjacent one side of the compartment and extending at least between the inlet and the fan, in which a bleed way is provided communicating between the compartment and the passageway arranged so that a differential pressure is created in use between the compartment and the passageway to draw air out of the compartment into the passageway, in which the bleed way for the passageway is positioned between the inlet and the fan.

2. A vacuum cleaner according to claim 1, in which vents in the compartment are positioned opposite one end of the motor and the bleed way is positioned opposite another end of the motor.

3. A vacuum cleaner according to claim 1, in which the motor is mounted on at least one inwarding extending rib in the compartment arranged to at least partially prevent air passing along an outside of the motor so that air which enters vents in the motor compartment is drawn through inside of the motor by the differential pressure.

4. A vacuum cleaner according to claim 1, in which a protrusion is provided upstream of the bleed way extending partially across the passageway to enhance the differential pressure created in the passageway.

5. A vacuum cleaner according to claim 4, in which the protrusion is integrally formed with the compartment.

6. A hand holdable vacuum cleaner having a fan, a vented compartment enclosing a motor connected to the fan through one end of the compartment, an inlet to allow air and debris to enter the cleaner, and a passageway extending between the inlet and the fan extending along one side of the compartment, in which a bleed way is provided communicating between the compartment and the passageway having a deflector adjacent the inlet extending into the passageway positioned downstream of the inlet arranged so that differential pressure is created in use by the deflector to draw air out of the compartment into the passageway and in which the housing is integrally formed to provide the inlet, the compartment, the passageway, the bleed way, and the protrusion.

7. A vacuum cleaner according to claim 6, in which the integrally formed housing is made in two like halves, each half comprising providing half of the compartment, half of the inlet, half of the passageway, half of the bleed way and half of the protrusion.

* * * * *